US006145689A

United States Patent [19]

Kobayashi et al.

[11] Patent Number: 6,145,689

[45] Date of Patent: Nov. 14, 2000

[54] CONTAINER CLOSURE HAVING PULL-OPENING TAB

[75] Inventors: Yukio Kobayashi, Tokyo; Masato Yamashita, Aichi-ken, both of Japan

[73] Assignees: Ishida Co., Ltd., Kyoto-fu, Japan; Showa Denko Plastic Products Co., Ltd., Tokyo, Japan

[21] Appl. No.: 09/274,967

[22] Filed: Mar. 23, 1999

[30] Foreign Application Priority Data

Mar. 25, 1998 [JP] Japan ..... 10-077007

[51] Int. Cl.[7] ..... B65D 17/40

[52] U.S. Cl. ..... 220/276; 220/270; 220/359.2; 220/359.3

[58] Field of Search ..... 220/270, 276, 220/359.2, 359.3, 359.4

[56] References Cited

U.S. PATENT DOCUMENTS

| | | | |
|---|---|---|---|
| 4,408,697 | 10/1983 | Yoshikawa et al. . | |
| 4,735,336 | 4/1988 | Buchner et al. | 220/270 |
| 4,828,135 | 5/1989 | Kawakami et al. | 220/270 |
| 4,966,301 | 10/1990 | Yamashita et al. | 220/270 |
| 4,988,013 | 1/1991 | Kobayashi et al. | 220/276 |
| 5,069,372 | 12/1991 | Kawajiri | 220/270 X |

FOREIGN PATENT DOCUMENTS

| | | |
|---|---|---|
| 0 322 238 | 6/1989 | European Pat. Off. . |
| 59-221256 | 12/1984 | Japan . |
| 62-168852 | 7/1987 | Japan . |
| 63-44441 | 2/1988 | Japan . |
| 4-55564 | 9/1992 | Japan . |
| 1 409 685 | 10/1975 | United Kingdom . |
| 2 029 381 | 3/1980 | United Kingdom . |

*Primary Examiner*—Stephen K. Cronin
*Attorney, Agent, or Firm*—Sughrue, Mion, Zinn, Macpeak & Seas, PLLC

[57] ABSTRACT

There is provided a container closure which is easy to manufacture and also easy to open. The container closure is provided with a peripheral section adapted to be attached to a peripheral edge portion of the top opening of a container body, and a panel section which is surrounded by the peripheral section. The panel section has a plastic material layer on the face of a gas blocking substrate, and a score line providing a weakened region in the plastic material layer on the periphery of the panel section. The panel section is provided with a pulling tab for allowing a container to be opened along the score portion by raising the pulling tab. The pulling tab is integrally molded with the plastic material layer of the panel section through a thin hinge so that the pulling tab can be pulled up with respect to the panel section. A projection made of plastic material and extending laterally with respect to the pulling tab, is molded integrally with the plastic material layer of the panel section adjacent to the front end of the pulling tab. An abutting end portion is formed at the front end of the pulling tab for contacting with the projection when the pulling tab is pulled up by a predetermined angle with respect to the panel section and for causing the panel section to be broken along the score portion by pushing the projection when the pulling tab is further pulled up.

9 Claims, 7 Drawing Sheets

FIG. 10

Table 1 Can Opening Property

| Operation | Evaluation | Examples |
|---|---|---|
| Lifting Tab | Easy to Lift by Finger? | 1. 5 |
| Puncture | Easy to Puncture ? | 1. 2 |
| Pull off | Strong Force not Required? | 1. 0 |
| Tear off | Easy to Tear off? | 0. 5 |

1) Five Points Evaluation;2(good),1,0,-1,-2(no good)
2) Average of 10 Panelers

Table 2 Drop Strength Test

| Height \ Samples | Examples |
|---|---|
| 50 cm | 0／10 |
| 60 cm | 0／10 |
| 70 cm | 0／10 |
| 80 cm | 0／10 |
| 90 cm | 0／10 |
| 100 cm | 2／10 |
| 110 cm | 1／8 |
| 120 cm | 2／7 |

CONTAINER CLOSURE HAVING PULL-OPENING TAB

FIELD OF THE INVENTION

The present invention relates to a container closure having a pulling tab for opening the container in which the closure is attached, in particular, to a container closure comprising a peripheral section adapted to be attached to a peripheral edge of an opening of a container body, a panel section surrounded by the peripheral section, a score portion formed on the periphery of the panel section for providing a weakened region, and a pulling tab provided on said panel section for allowing said container to be opened by separating the panel section along said score portion from said peripheral section by pulling said pulling tab up. The present invention, though not limited to any specific use, is effective when applied to a container closure in which at least portions of the panel portion and the pulling tab are formed by molding a plastic material.

PRIOR ART

It is common to store beverage and food in a container like a can and close the container tightly with a sealing closure for preservation or sales display at shop front. A closure for this type of container is structured to have a score line for breaking the closure so that the container is opened by pulling a pulling tab provided to the closure to thereby break the closure along the score line.

Conventional container closures provided with this type of pulling tab may include those which are totally or substantially formed of a metallic material and those which are formed of a plastic material by injection molding. The closure using plastic material generally has a gas barrier layer whose major component is aluminum foil which is covered by layers of a plastic material formed by injection-molding on either or both sides of the gas barrier layer. At the peripheral section formed is a rim to be attached to a peripheral edge portion of the opening of the container body. In the case Where the major component of the container closure is formed of a metallic material, the pulling tab is also formed of the metallic material and is riveted to the closure body. In the case where the major component of the container closure is formed out of a plastic material, the pulling tab is also formed of a plastic material and bonded to the closure body through a suitable bonding technique such as by an ultrasonic welding, as described in the Japanese Laid-Open Patent Publications Nos. Sho 62-168852 and Sho 63-44441.

In either case, the pulling tab is disposed substantially in parallel with the plane of the closure panel. When it is desired to open the closure, the pulling tab has first to be pulled up. The pulling tab has a front end portion which is generally disposed in the vicinity of the score line. As the pulling tab is pulled up, the front end portion is pushed downward by leverage effect. The pulling tab of the conventional structure is, however, not easy to handle particularly in the initial stage of opening process. When the pulling tab is being pulled up in the initial stage of opening process, the tab has to be raised to a certain angle with respect to the plane of the closure panel, however, this task is not easy since the pulling tab is disposed nearly parallel to the container panel. Further, since the pulling tab is formed separately from container body and later attached to the container body, an additional manufacturing process is required, and therefore, cost for the product is increased.

Japanese Patent Publication No. Hei 4-55564 discloses a manufacturing process, which uses a prefabricated pulling tab formed at the portion to be fixed to the container body with an attachment aperture. The pulling tab is then placed in the mold together with the gas barrier multi-layered sheet and molten plastic material is then injected into the mold cavity. This process also requires steps of molding a pulling tab and then molding a closure using this molded pulling tab. Thus, complicated process steps are required.

Japanese Laid-Open Patent Publication No. Sho 59-221256 discloses a process in which the pulling tab is simultaneously molded together with the panel portion. In this process, the panel portion is formed by injection-molding a plastic material layer onto a multi-layered sheet including a gas barrier material. In the method disclosed in this Japanese Laid-Open Patent Publication, the multi-layered sheet is in advance applied at an area where the pulling tab is to be molded (hereafter referred to as "pulling tab molding area") with a separating agent, and plastic material is injected thereon. A groove is formed around the pulling tab molding area for separating the pulling tab molding area from its outside area.

The method described in this Japanese Laid-Open Patent Publication has an advantage in that the pulling tab of the container and the container body can be molded at the same time. It should however be noted that the method is disadvantageous in that an additional step of applying the separating agent is required. Further, it should be noted that, in the proposed process, it is also required to make a precise registration of the area where the separating agent to be applied. Another problem which may be encountered in this process is that the separating agent may be removed during the molding due to the heat and flow of the injected molten plastic material.

DISCLOSURE OF THE INVENTION

It is therefore an object of the present invention to provide a container closure which is easy to manufacture and convenient to open.

Another object of the present invention is to provide a method for manufacturing such container closure.

In order to accomplish the above and other objects, the present invention provides a container closure comprising a peripheral section adapted to be attached to a peripheral edge portion of an opening of a container body, a panel section covering an area surrounded by said peripheral section. The closure includes a score portion formed along the periphery of the panel section to provide a weakened region. A pulling tab is attached to the panel section by pulling the pulling tab up to thereby separate the panel section from the peripheral section along the score line. On the panel section, there is provided a projection extending laterally with respect to the pulling tab at a position adjacent to the front end portion of the pulling tab. The pulling tab has an abutting end portion at the front end portion for engagement with the projection when the pulling tab is pulled up by a predetermined angle with respect to the panel section and for causing the panel section to be broken along the score portion by pushing the projection as the pulling tab is further pulled up. This container closure may be formed of any material.

A container closure in accordance with the present invention suitable for manufacture by a plastic molding comprises a peripheral section adapted to be attached to a peripheral edge portion of an opening of a container body and a panel section covering an area surrounded by the peripheral section. The panel section includes a substrate of gas blocking property having a layer of a plastic material formed on at least one side thereof. The closure further includes a score portion formed along a periphery of the panel section to provide a weakened region. A pulling tab is attached to the panel section for allowing a container to be opened by pulling the pulling tab up to thereby separate the panel section from the peripheral section along the score portion. The pulling tab is integrally molded together with the plastic material layer of the panel section through a thin walled hinge portion so that the pulling tab can be pulled up with respect to the panel section. A projection is molded integrally with the plastic material layer of the panel section adjacent to a front end portion of the pulling tab. The projection is made of a plastic material and extends laterally with respect to the pulling tab. An abutting end portion is formed at the front end of the pulling tab and adapted to be brought into engagement with the projection when said pulling tab is pulled up by a predetermined angle with respect to the panel section to cause the panel section to be broken along the score portion by pushing the projection as the pulling tab is further pulled up with respect to the panel section. The score portion may be formed by molding the plastic layer in the panel section in a manner that the the plastic material of the panel section is interrupted and the gas blocking substrate is thus exposed at the area of the score portion.

In a container closure of the present invention, a holding portion is desirably formed at the panel section for releasably holding the pulling tab substantially in parallel with and close to the panel section. Further, the projection desirably comprises a ridge extending laterally with respect to the pulling tab, and a reinforcement extending at a side opposite to the pulling tab with respect to the ridge in a direction intersecting the ridge for transmitting a pushing force. In this case, the reinforcement for transmitting pushing force is desirably formed to extend to a position close to the score portion. A preferable operation of the pulling tab can be obtained if the angle for the pulling tab is determined so that the abutting end portion of the front end of the pulling tab is brought into contact with the projection when the pulling tab is raised to an angle between 30 and 90 degrees with respect to the panel section.

In a container closure of the present invention, at least on the peripheral section, a heat sealable material layer may be applied on the side opposite to the pulling tab. The container closure may then be fastened to the peripheral edge portion of the opening of the container body at the area of this heat sealable material.

The present invention also provides a method for molding the above mentioned container closure through a plastic molding. The method comprises the steps of providing a lower mold part having a molding face for supporting the gas blocking substrate, at least one slide core having a molding face for molding a part of an upper face of the panel section and a lower face of the pulling tab including the hinge portion with the pulling tab positioned with an angle smaller than the aforementioned predetermined angle with respect to the panel section, and an upper mold part having a molding face for forming a molding cavity together with the slide core and the lower mold, and then injecting a molten plastic material into the molding cavity, and thereafter removing the upper mold after the plastic material has been solidified, removing the slide core and taking out a molded product, molded pulling tab being deflected while the molded product is being taken out in the direction to increase the angle between the molded pulling tab and the panel section in the molded product.

In a container closure of the present invention, at the initial stage of raising the pulling tab with respect to the panel face, no force for opening a container is applied to said pulling tab. Therefore, the pulling tab can easily be raised when the container is to be opened. after the front end of the pulling tab comes into contact with the projection, further lifting movement of the pulling tab in a direction to raise the pulling tab causes a force to be added from the projection to the score line of the panel section, and then the panel section is broken off along the score line. In the case where the projection comprises a ridge extending laterally with respect to the pulling tab and a reinforcement extending at a side opposite to the pulling tab with respect to the ridge in a direction intersecting the ridge for transmitting pushing force, a breaking force can effectively be applied to the score line by locating the front end of said reinforcement in the vicinity of the score line.

According to a manufacturing method of the present invention by plastic material molding, a container closure can easily manufactured in a single process using a molding die having the aforementioned slide core. In this case, since a pulling tab is molded in a manner that it is allowed to swing around a hinge with respect to the panel section of the container closure, the pulling tab can be easily removed from the mold because the pulling tab can be deflected at its hinge portion. Further, no additional process for attaching the pulling tab is necessary after the closure has been molded.

BRIEF DESCRIPTION OF THE DRAWINGS

FIGS. 9*a*, 9*b*, and 9*c* respectively showing the state of the upper and lower molds after being separated; and FIG. 10 shows tables showing the evaluation test results of the containers of the present evaluation.

DESCRIPTION OF THE PREFERRED EMBODIMENT

Figure 1:
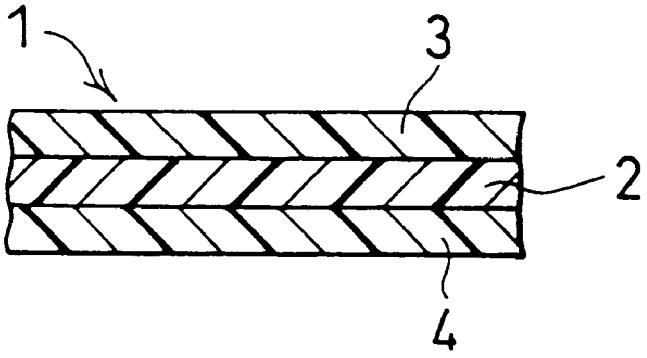
FIG. 1 is a sectional view of a gas barrier material used as a container closure of an embodiment of the present invention.

The present invention will hereafter be described taking reference to the accompanying drawings which show an embodiment thereof. Referring now to FIG. 1, there is shown an example of a gas blocking substrate 1 which may be used for forming a panel section in accordance with an embodiment of the present invention. The gas blocking substrate 1 comprises a thin sheet 2 which may be a metal foil such as aluminum foil, iron foil, and the like, or a sheet of any other material of gas blocking property such as saponified ethylene vinyl acetate copolymer, polyvinylidene chloride, poly-amide, poly-acrylo nitrile, or the like. Layers 3, 4 of a heat-fusible plastic material are formed on the opposite surfaces of the sheet 2. The layer 3 is provided to cover the upper face of the sheet 2 and made of a material capable of forming an intimate layer together with a plastic layer which will be formed in later stage by injection molding over the gas barrier substrate 1. Materials which can be used for this purpose include polypropylene, polyethylene, polyester, polyamide, polycarbonate, polystyrene, and the like. In case of a container for retort pouch food, polypropylene is preferable. The plastic material layer 4 is provided on the lower face of the sheet 2 and is adapted for heat sealing the closure to the peripheral edge portion of the top opening of a container body. Preferable materials for this purpose incluse polypropylene, polyethylene, polyester, polyamide, polycarbonate, polyacrylo nitrile, polystyrene, or any other adhesive materials such as maleic anhydride graft polymerized carboxyl group denatured polypropylene, carboxyl group denatured linear low density polyethylene.

Figure 2:
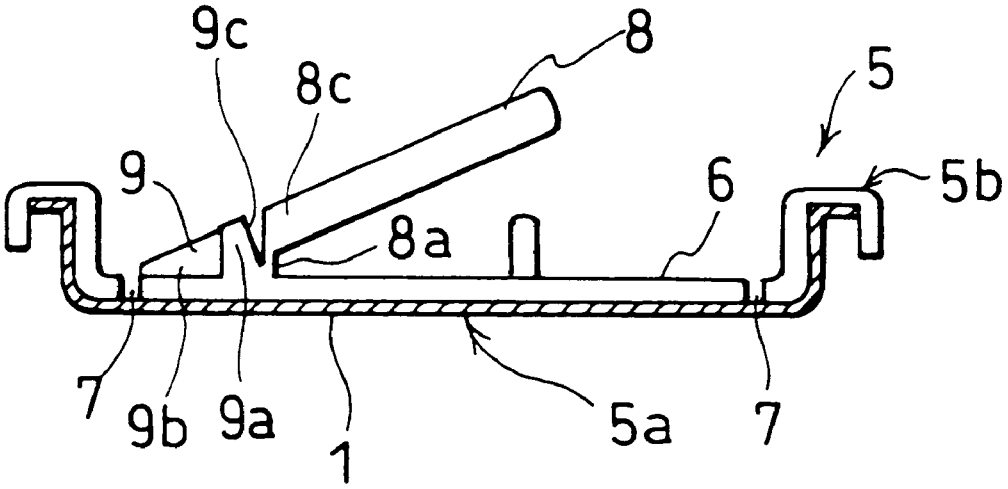
FIG. 2 is a sectional view of a container closure in accordance with one embodiment of the present invention.
Figure 3:
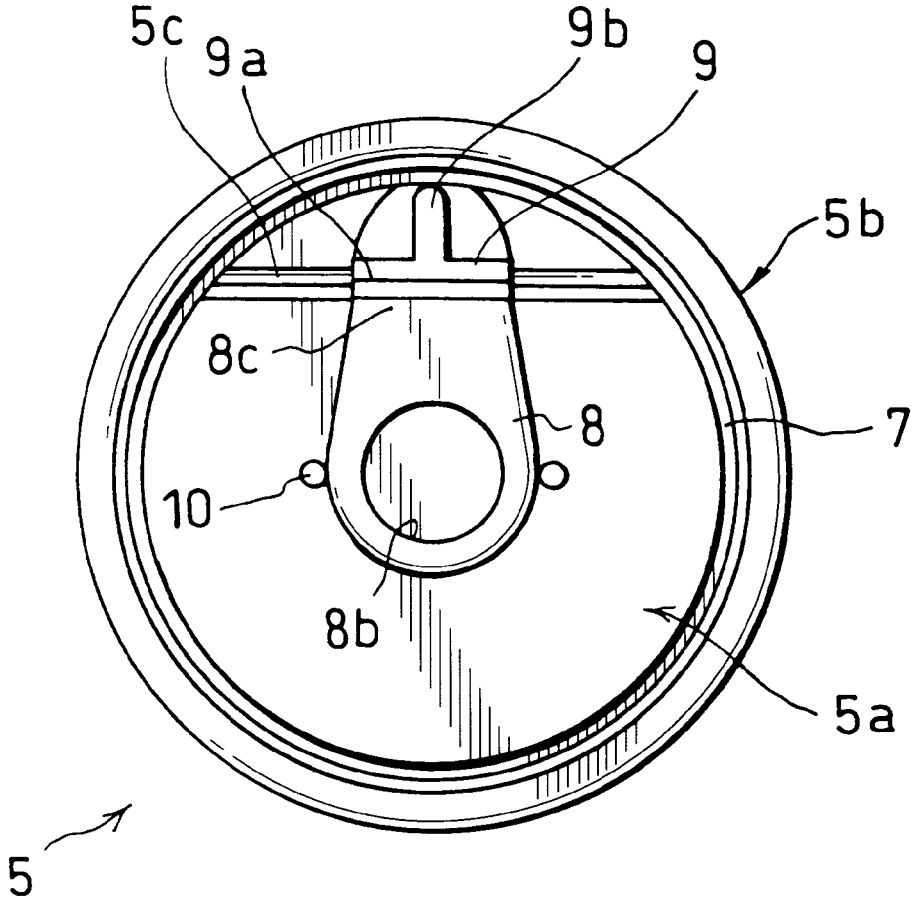
FIG. 3 is a plan view of the container closure of FIG. 2.

FIGS. 2 and 3 show a container closure 5 embodying the present invention. The closure 5 comprises a gas blocking substrate 1 shown in FIG. 1 and a layer 6 of a plastic material formed on the upper face of the substrate 1. The container closure 5 comprises a planar panel section 5*a* which is shaped to conform with a top opening of a container body (not illustrated) such as a can and an annular peripheral section 5*b* including a raised ridge portion formed along a periphery of the panel section 5*a*. The peripheral section of the gas blocking substrate 1 is bent to form a substantially Z-shaped cross-section as shown in FIGS. 2 and 4. The peripheral section of the plastic material layer 6 has a portion which is laid over the peripheral portion of the gas blocking substrate 1 and the outer fringe of the plastic material layer 6 is further bent downward to form a downwardly opening annular groove.

A score line 7 is formed substantially along the inner circumference of the peripheral section 5*b* of the container closure 5. In the present embodiment, the score line 7 is formed by making the plastic material layer 6 to be discontinuous to thereby expose the gas blocking substrate 1. In the portion of the panel section 5*a* surrounded by the score line 7, there is a pulling tab 8 which is integrally molded together with the plastic material layer 6. A groove 5*c* is formed in the plastic material layer 6 on the panel section 5*a* to extend in the direction of a chord of the panel section 5*a* at a position corresponding to the front end of the pulling tab. This groove 5*c* is formed by providing a thin walled portion in the plastic material layer 6 on the panel section 5*a*.

As shown in FIG. 2, the pulling tab 8 is connected through a thin walled hinge portion 8*a* to the plastic material layer 6 on the panel section 5*a*. As shown in FIG. 3, the pulling tab 8 is a substantially planar configuration having an aperture 8*b* for accommodating a finger for opening the closure. The thickness of the tab 8 is substantially uniform throughout the length as shown in FIG. 2. In a preferable embodiment, the thickness of the pulling tab is approximately 0.5 mm to 5.0 mm and that of the hinge portion is approximately 50 $\mu$m to 500 $\mu$m.

A projection 9 is formed and located adjacent to the front end portion 8*c* of the pulling tab 8. This projection 9 comprises a ridge 9*a* which is located outside the groove 5*c* at a position close to the score line. The ridge 9*a* extends along the score line 5*c*. There is also formed a reinforcement 9*b* for transmitting pushing force from the tab 8 to the panel section 5*a*. The reinforcement 9*b* is formed integrally with the ridge 9*a* so as to extend outwards from the central portion of the ridge 9*a* toward the score line 7. The ridge 9*a* of the projection 9 has a slant face 9*c* which is adapted to be brought into contact with the front end of the pulling tab 8 (hereafter referred to as a slant contacting face 9C) when the pulling tab 8 is pulled up from the panel 5*a*.

Figure 4A:
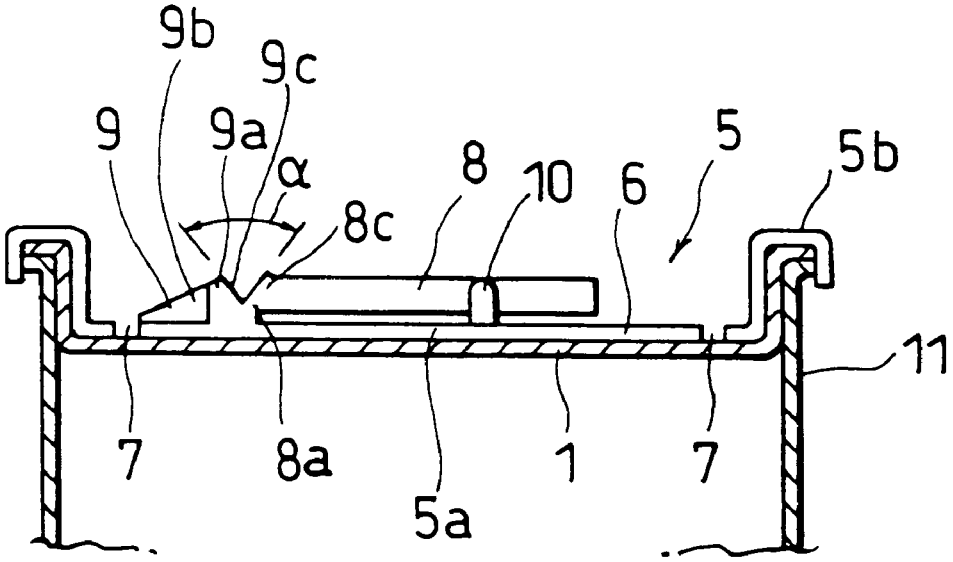
FIGS. 4*a* and 4*b* are sectional views showing how the holding portion of the container closure of FIGS. 2 and 3 works, FIG. 4*a* and FIG. 4*b* showing an overall sectional view of a closure and another sectional view respectively, and the viewing direction of FIG. 4*b* being right to that of FIG. 4*a;*
Figure 4B:
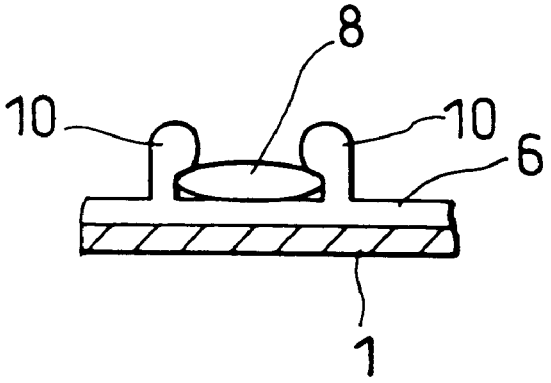

As shown in FIG. 4*b*, a pair of holding portions 10 are formed on the upper face of the plastic material layer 6 of the panel section 5*a* of the container closure 5. These holding portions 10 resiliently hold the pulling tab 8 at both sides thereof and thereby function so that the pulling tab 8 is held substantially in parallel with the panel section 5*a* as shown in FIGS. 4*a*, 4*b*. As shown in FIG. 4*a*, in the position where the pulling tab 8 is held substantially parallel with the panel section 5*a*, a V-notch having an including angle $\alpha$ is formed between the front end 8*c* of the pulling tab 8 and the slant contacting face 9*c* of the ridge 9*a* of the projection 9. The container closure 5 shown in FIG. 4 is heat sealed to the peripheral edge portion of the upper opening of the container body 11.

Figure 5:
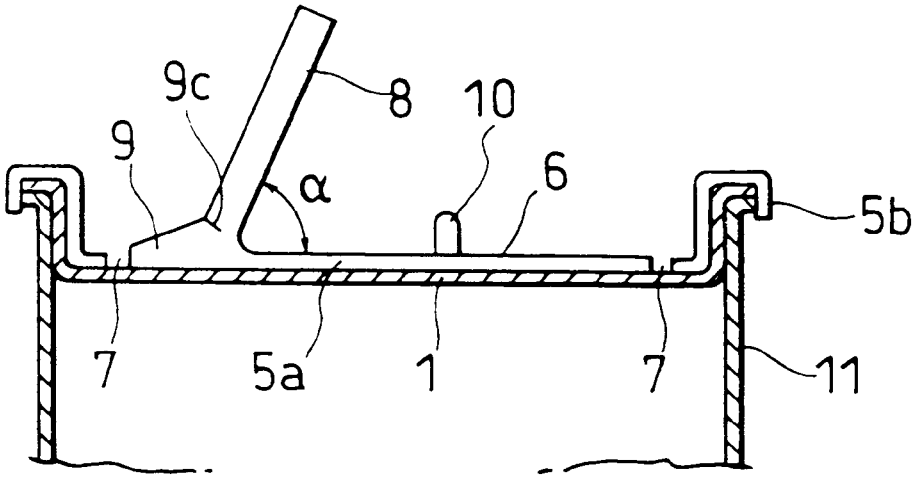
FIG. 5 is a sectional view similar to FIG. 2 but showing the initial stage of opening the container closure of the embodiment of the present invention.
Figure 6:
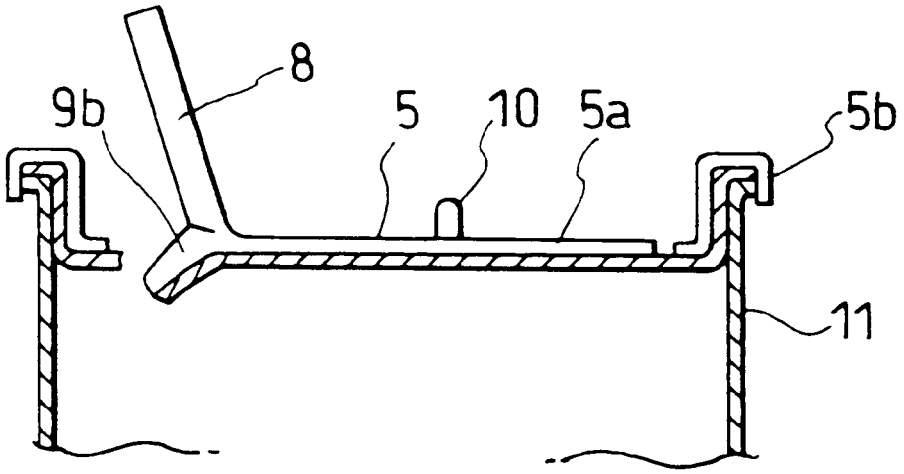
FIG. 6 is a sectional view similar to FIG. 5 but showing a further advanced stage of opening the container closure of the embodiment of the present invention.

When it is desired to open the closure, the pulling tab 8 is pulled up from the face of the panel section 6 to the position shown in FIG. 5, so that the front end 8*c* of the pulling tab 8 is brought into contact with the slant contacting face 9*c* formed on the ridge 9*a* of the projection 9. When the pulling tab 8 is pulled up to the angle $\alpha$, the front end 8*c* of the pulling tab 8 contacts with the slant contacting face 9*c* formed at the ridge 9*a* of the projection 9. In this position, when the pulling tab is further pulled upwards, the reinforcement 9*b* of the projection 9 penetrates into the gas blocking substrate 1 of the panel section 5*a* so that the panel section 5*a* is broken along the score line 7 as shown in FIG. 6. Then the pulling tab 8 is further pulled up, to cause the panel section 5*a* of the closure 5 to be separated along the score line 7 from the peripheral section 5*b*. In the present invention, the angle $\alpha$ is preferably determined to be between 30 and 90 degrees but a larger angle up to 120 degrees, for example, may be adopted.

As described above, the score line 7 is formed by making the plastic material to be discontinuous to thereby expose the gas blocking substrate. In order for providing the properties of readiness of opening the container through the aforementioned processes, as well as the drop-resistant strength of the tightly-closed container, break-resistant strength in molding, etc., the thickness of the sheet 2 of the gas blocking substrate 1 is preferably determined to be less than 50 $\mu$m and preferably about between 9 $\mu$m and 30 $\mu$m. The thickness of each of the plastic material layers 3, 4 is preferably less than 100 $\mu$m. The width of the score line 7 should not be so large and is preferably less than 2.0 mm and more preferably less than 1.0 mm.

Figure 7:
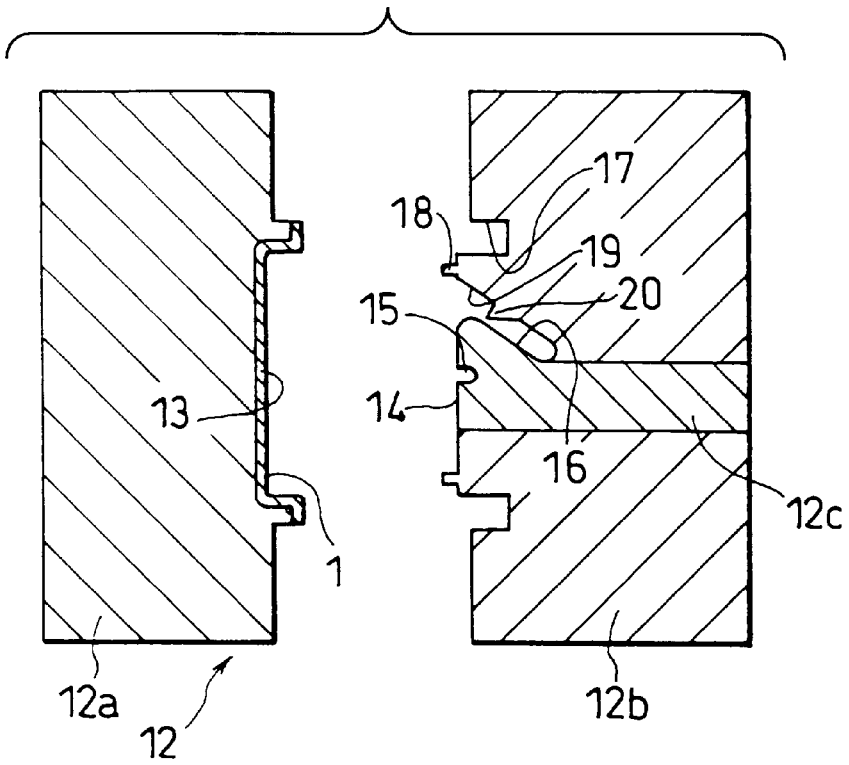
FIG. 7 is a sectional view of a set of mold parts used for manufacturing the container closure of the present invention.

FIG. 7 shows an injection mold assembly 12 employed for molding a container closure 5 of an embodiment of the present invention. The mold 12 comprises a lower mold 12*a*, an upper mold 12*b*, and a slide core 12*c*. The lower mold 12*a* has a recessed mold portion 13 for disposing the gas blocking substrate 1 of the container closure 5. The slide core 12*c* is arranged so as to slide up and down in the upper mold 12*b*. The slide core 12*c* is provided at its lower end with a flat plane 14 for forming the upper face of the plastic material layer 6 and a recess 15 for forming the holding portions 10. The slide core 12*c* is provided with an upwardly facing molding face 16 which is slanted with respect to the flat plane 14 by a predetermined angle for forming the pulling tab 8. The inclination angle of the molding face 16 with respect to the flat face 14 is smaller than the angle α described above. The upper mold 12*b* comprises a molding recess 17 for molding the peripheral section 5*b* and an annular projection 18 for forming the score line 7. Further the upper mold 12*b* comprises a molding face 19 adapted to cooperate with the molding face 16 of the slide core 12*c* for molding the pulling tab and a projection 20 for forming the hinge portion 8*a*.

Figure 8:
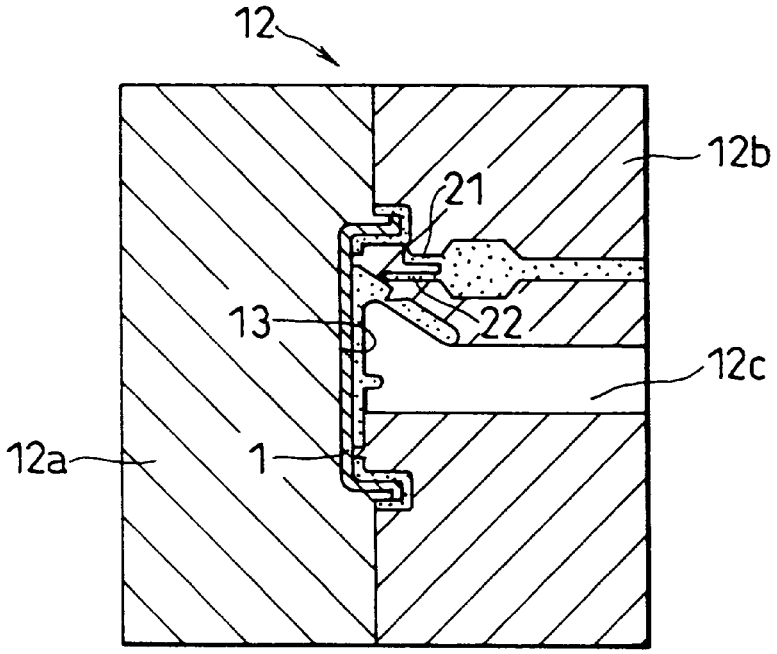
FIG. 8 is a sectional view showing the process of injecting the plastic material during the container closure manufacturing process using the mold of FIG. 7.

As shown in FIG. 8, after the upper mold 12*b* has been assembled with the slide core 12*c* inserted into the upper mold 12*b*, the gas blocking substrate 1 is disposed on the mold recess portion 13 of the lower mold 12*a*, and the upper mold 12*b* is then placed on the lower mold 12*a* to form a molding cavity for injecting molten plastic material. The upper mold 12*b* comprises two injection gates 21, 22 for injecting the molten plastic material into the molding cavity. The gate 21 is open to the cavity at a position corresponding to the peripheral section 5*b* of the container closure 5. The gate 22 is open to the cavity at a position corresponding the projection 9.

Figure 9A:
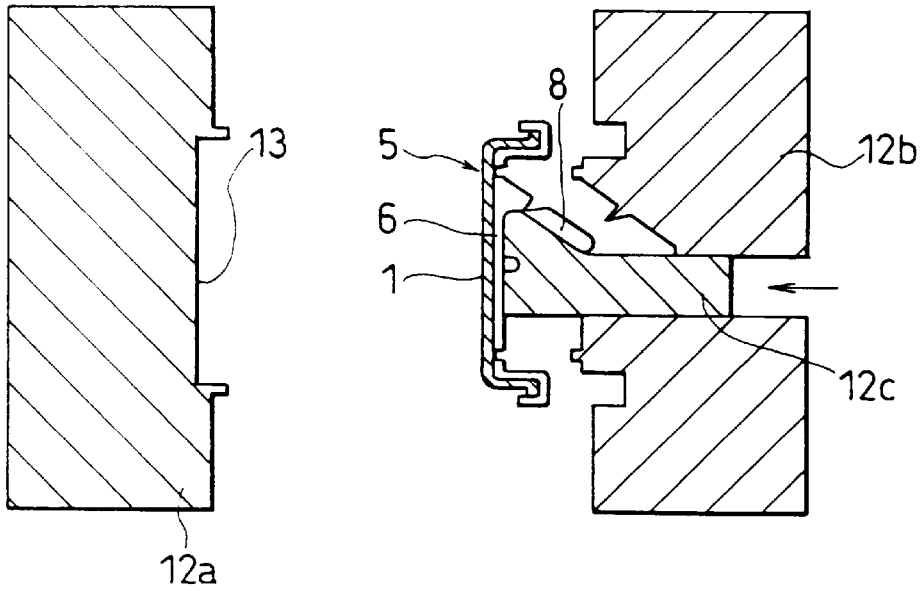
FIGS. 9*a*, 9*b*, 9*c* show the steps of taking out the molded container closure from the molds shown in FIG. 7.
Figure 9B:
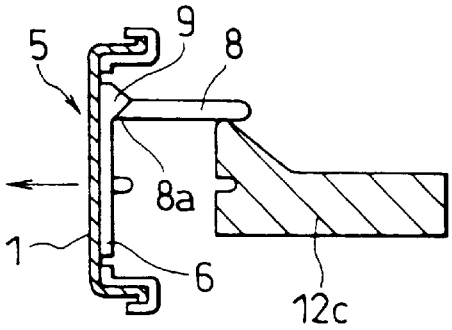

In this condition, molten plastic material is injected from the gates 21, 22 into the mold to completely fill the cavity. The injected plastic material forms the plastic material layer 6 on the gas blocking substrate 1. After the injected plastic material has been solidified, the upper mold 12*b* is separated from the lower mold 12*a* as shown in FIG. 9*a*. In this step, the slide core 12*c* is also separated from the lower mold 12*b*. The molded container closure 5 is separated together with the slide core 12*c* from the lower mold 12*a* and the upper mold 12*b*. After this step, as shown in FIG. 9*b*, the pulling tab 8 on the molded product is deflected around its hinge portion 8*a* and thereby the molded container closure 5 is removed from the slide core 12*c*.

Figure 9C:
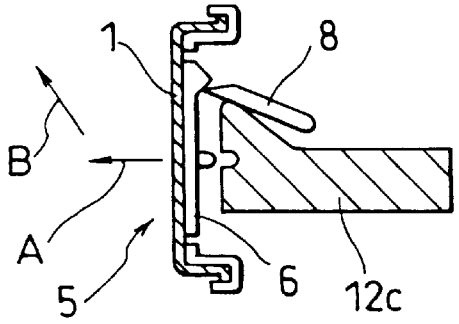

FIG. 9*c* shows another method for removing the molded container closure 5 from the slide core 12*c*. In this method, the molded container closure 5 is moved downwards a little with respect to the slide core 12*c*. At this moment, the molded pulling tab 8 is deflected only a bit. Then, by moving the container closure 5 obliquely in the direction as indicated by an arrow B, the container closure 5 can be removed from the slide core 12*c*.

Materials such as polypropylene, polyethylene, polyester, polyamide, polycarbonate, and polystyrene may be used for molding the plastic material layer 6. An inorganic filler may be mixed to these materials. The mixed inorganic filler improves the dimensional stability of the container closure and reduces the thermal contraction rate. Further, the addition of such inorganic material is effective to improve thermal resistance, with the result that the thermal deformation temperature can be increased, and the thermal conductivity can be improved. Such property of the closure is preferable for use with a container for retort pouch food. Further, it should be noted that, in disposing the container closure after use, the thermal calorie produced during the incineration can be decreased. This property is effective to protect the incinerator from thermal damage. The added inorganic filler can give the container closure more rigidity which provides advantages for the distribution of product.

As an inorganic filler, those employed as additives in the fields of synthetic plastic material or rubber are available. For example, any substance may be employed so long as it is an inorganic compound inactive to oxygen and water, preferable in terms of food sanitation, and not dissolvable during the process of kneading and molding. For example, use may be made of materials such as compounds like metal oxide, hydrate (hydroxide) thereof, sulfate, carbonate, silicate of a metal, and their double salts, or their compounds. Further, materials which may be used for the purpose include aluminum hydrate, calcium hydrate, magnesium hydrate, zinc oxide, red lead, magnesium carbonate, calcium carbonate, white carbon, talc, mica, glass fiber, glass powder, glass beads, diatomaceous earth, silica, wollastonite, iron oxide, titanium oxide, lithopone, pumice powder, gypsum, barium carbonate, dolomite, and iron sand. Among these filler matarials, those in powder form preferably have a diameter less than 2 μm, more preferably less than 10 μm. Those in fiber form preferably are from 1 to 500 μm in diameter, more preferably from 1 to 300 μm, and are from 0.1 to 6 mm in length, more preferably from 0.1 to 5 mm. Those in planar form are preferably less than 30 μm in diameter, more preferably from 1 to 10 μm. Among these inorganic fillers, those of planar o r powder form are especially preferable. Be sides those described above, various additives including pigment may be added to the plastic material for use in the injection molding.

Specific examples of the present invention and comaparative examples will now be described.

EXAMPLE

A gas blocking barrier multi-layered substrate 1 was prepared by an aluminum foil 2 of 30 μm thick which is attached at one side with an ethylene propylene block copolymer (MFR=1.1, ethylene content 9 wt %) film of 30 μm thick which functions as a heat-fusible layer to be bonded to a container body, through a maleic anhydride graft polymerized polypropylene plastic material (MFR=20) layer of 3 μm thick placed therebetween. The layers were firmly fixed together by passing through a thermal roll to apply heat. On the other side of the aluminum foil 2 of the gas blocking barrier multi-layered substrate 1, there was formed a layer of ethylene propylene block copolymer (MFR=1.1, ethylene content 9 wt %) film of 30 μm thick which is attached to the aluminum foil by a polyurethane based adhesive (4.5 g/m$^2$). The layer function s as a heat fusible layer adapted to be integrated with an injection plastic material whch will be injected on the substrate 1 in a later stage.

The multi-layered substrate 1 was disposed in the recessed mold portion 13 of the lower mold 12*a* of the mold 12 shown in FIG. 8, and ethylene propylene block copolymer (Showa Denko ShowAromer MK-451-2) was injected through the gates 21, 22 shown in FIG. 8 by an injection molding machine Toshiba IS50A(302) with the temperature and pressure at the injection cylinder being set at 240° C. and 60 Kg/cm$^2$ respectively and thereby a container closure 5 shown in FIGS. 2, 3 was molded.

A polypropylene container was fully filled with water of 230 g and the container closure was heat sealed by high frequency sealing process and a retort sterilization at 125° C. for 30 minutes was then implemented to make the test sample.

Using samples of the present invention, pulling tab operation feeling was evaluated by 10 panelists and the drop strength was evaluated in the actual drop test. Table 1 and Table 2 in FIG. 10 show the results of operation feeling and drop strength respectively. As seen from Table 1 for the result of the operation feeling, the container closure of the present invention is better than that of the prior art in the point that the pulling tab is easy to lift. While a container closure of the present invention allows its pulling tab to be pulled up without resistance only by removing the pulling tab from the holding portion and to be lifted till the front end of the pulling tab contacts with the slant contacting face of the projection, a container closure of the prior art makes it difficult for a finger to be put between the pulling tab and the panel section and also makes it difficult for the pulling tab to be lifted.

Drop strength was evaluated by dropping a container fully filled with water onto a concrete floor. The container was dropped in a direction that the joint portion of the closure and the container body on the side of the front end of the pulling tab would first hit the floor. The drop height in the test was incrementally changed from 50 cm by every 10 cm. In Table 2, the denominator and the numerator are the number of tested samples and the number of broken samples, respectively. In all samples, the breakage occurred at the score line of the container closure. As seen from Table 2, the container closure of the present invention has a high strength against breakage.

It will be noted from the above description, the present invention can provide a container closure which can be readily manufactured and easy to open. Further, the container closure of the present invention has a higher drop strength than that of the prior art.

What is claimed is:

1. A container closure comprising:

a peripheral section adapted to be attached to a peripheral edge of an opening of a container body;

a panel section having a surface portion and covering an area surrounded by the peripheral section;

a score portion formed along a periphery of the panel section to provide a weakened region;

a pulling tab on said surface portion of the panel section for allowing a container to be opened by pulling up to thereby separate the panel section from the peripheral section along the score portion; characterized by at least said surface portion of said panel section being formed of a plastic material;

said pulling tab being formed of a plastic material which is the same as that with which said surface portion of said panel section is formed;

a projection formed on the panel section adjacent to a front end portion of the pulling tab to extend laterally with respect to the pulling tab; and an abutting end portion formed at the front end portion of said pulling tab and adapted to be brought into engagement with said projection when said pulling tab is pulled up by a predetermined angle with respect to said panel section to cause said panel section to be broken along said score portion by pushing said projection as said pulling tab is further pulled up with respect to said panel section.

2. A container closure in accordance with claim 1, which includes a holding portion formed in said panel section so as to releasably hold said pulling tab substantially along said panel section.

3. A container closure in accordance with claim 1, wherein said abutting end portion on the front end of said pulling tab is brought into contact with said projection when said pulling tab is pulled up by an angle between 30 and 90 degrees with respect to said panel section.

4. A container closure in accordance with claim 1, wherein said peripheral section is formed on the side opposite to said pulling tab with a layer of heat sealable material.

5. A container closure in accordance with claim 1, wherein said projection comprises a ridge extending laterally with respect to said pulling tab and a reinforcement formed at a side opposite to said pulling tab with respect to said ridge to extend in a direction intersecting said ridge.

6. A container closure in accordance with claim 5, wherein said reinforcement extends to a portion close to said score portion.

7. A container closure comprising:

a peripheral section adapted to be attached to a peripheral edge of an opening of a container body;

a panel section covering an area surrounded by said peripheral section, said panel section including a substrate of gas blocking property having a layer of a plastic material formed on at least an outer side thereof;

said closure further including a score portion formed along a periphery of said panel section to provide a weakened region;

a pulling tab attached to said outer side of said panel section for allowing a container to be opened by pulling said pulling tab up to thereby separate said panel section from said peripheral section along said score portion;

said pulling tab being formed of the same plastic material as said plastic material layer and integrally molded together with said plastic material layer of said panel section through a thin walled hinge portion so that said pulling tab can be pulled up with respect to said panel section;

a projection molded integrally with said plastic material layer of said panel section and located adjacent to a front end portion of said pulling tab, said projection being made of a plastic material and extending laterally with respect to said pulling tab; and an abutting end portion formed at the front end portion of said pulling tab and adapted to be brought into engagement with said projection when said pulling tab is pulled up by a predetermined angle with respect to said panel section to cause said panel section to be broken along said score portion by pushing said projection as said pulling tab is further pulled up with respect to said panel section.

8. A container closure in accordance with claim 7, wherein said score portion is formed by molding a plastic material layer of said panel section so that the plastic material of said panel section is made discontinuous with respect to the plastic material of said peripheral section to thereby expose said gas blocking substrate.

9. A method for molding a container closure as defined by claim 7, said method comprising the steps of;

preparing a lower mold part having a molding face for supporting said gas blocking substrate, at least one slide core having a molding face for molding a part of an upper face of said panel section and a lower face of said pulling tab including said hinge portion with said pulling tab positioned with an angle smaller than said predetermined angle with respect to said panel section, and an upper mold part having a molding face for forming a molding cavity together with said slide core and said lower mold;

injecting molten plastic material into said molding cavity; and removing said upper mold after said plastic material has been solidified, removing said slide core and taking out a molded product, molded pulling tab being deflected while the molded product is being taken out in the direction to increase the angle between said molded pulling tab and the panel section in the molded product.

* * * * *